US006742598B2

(12) United States Patent
Whitelaw et al.

(10) Patent No.: US 6,742,598 B2
(45) Date of Patent: Jun. 1, 2004

(54) METHOD OF EXPANDING A SAND SCREEN

(75) Inventors: Calum Whitelaw, Aberdeenshire (GB); Keith Slater, Scotland (GB); Rick Overman, Scotland (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/157,307

(22) Filed: May 29, 2002

(65) Prior Publication Data

US 2003/0221840 A1 Dec. 4, 2003

(51) Int. Cl.[7] ..... E21B 43/10

(52) U.S. Cl. ..... 166/387; 166/118; 166/207; 166/227; 166/236

(58) Field of Search ..... 166/387, 206, 166/207, 227, 228, 233, 236, 51, 241.6, 119, 118

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | |
| 2,383,214 | A | 8/1945 | Prout | |
| 2,499,630 | A | 3/1950 | Clark | |
| 2,627,891 | A | 2/1953 | Clark | |
| 2,663,073 | A | 12/1953 | Bieber et al. | |
| 2,898,971 | A | 8/1959 | Hempel | |
| 3,087,546 | A | 4/1963 | Woolley | |
| 3,195,646 | A | 7/1965 | Brown | |
| 3,467,180 | A | 9/1969 | Pensotti | |
| 3,477,506 | A | 11/1969 | Malone | 166/207 |
| 3,818,734 | A | 6/1974 | Bateman | 72/75 |
| 3,911,707 | A | 10/1975 | Minakov et al. | 72/76 |
| 4,069,573 | A | 1/1978 | Rogers, Jr. et al. | 29/421 |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,324,407 | A | 4/1982 | Upham et al. | 277/27 |
| 4,429,620 | A | 2/1984 | Burkhardt et al. | 91/395 |
| 4,502,308 | A | 3/1985 | Kelly | 72/58 |

(List continued on next page.)

FOREIGN PATENT DOCUMENTS

| | | | |
|---|---|---|---|
| EP | 0 952 305 A1 | 10/1999 | E21B/43/10 |
| EP | 0 961 007 A2 | 12/1999 | E21B/33/10 |
| GB | 1457843 | 12/1976 | B21D/39/10 |
| GB | 2 313 860 A | 12/1997 | E21B/10/34 |
| GB | 2 320 734 A | 7/1998 | E21B/33/127 |
| GB | 2 368 082 | 4/2002 | E21B/43/10 |
| WO | WO 93/24728 | 12/1993 | E21B/17/10 |
| WO | WO 96/21083 | 7/1996 | E21B/43/10 |
| WO | WO 99/18328 | 4/1999 | E21B/23/01 |
| WO | WO 99/23354 | 5/1999 | E21B/43/10 |
| WO | WO 02/052124 | 7/2002 | E21B/33/124 |

OTHER PUBLICATIONS

Pre–Grant Pub US 2002/0092648 A1, Johnson et al., Jul. 2002.*

PCT International Search Report, International Application No. PCT/GB 03/02093, dated Sep. 1, 2003.

*Primary Examiner*—Zakiya Walker

(74) *Attorney, Agent, or Firm*—Moser, Patterson & Sheridan, L.L.P.

(57) ABSTRACT

Apparatus and methods are provided for expanding an expandable tubular in the wellbore. In one aspect, the expandable tubular is expanded using an inflatable packer. In another aspect, the expandable tubular is an expandable sand screen.

49 Claims, 8 Drawing Sheets

U.S. PATENT DOCUMENTS

| | | | | |
|---|---|---|---|---|
| 4,531,581 | A | 7/1985 | Pringle et al. | 166/120 |
| 4,588,030 | A | 5/1986 | Blizzard | 166/120 |
| 4,697,640 | A | 10/1987 | Szarka | 166/120 |
| 4,848,469 | A | 7/1989 | Baugh et al. | 166/382 |
| 5,271,472 | A | 12/1993 | Leturno | 175/107 |
| 5,322,127 | A | 6/1994 | McNair et al. | 166/313 |
| 5,409,059 | A | 4/1995 | McHardy | 166/208 |
| 5,417,289 | A | 5/1995 | Carisella | 166/387 |
| 5,435,400 | A | 7/1995 | Smith | 175/61 |
| 5,469,919 | A | 11/1995 | Carisella | 166/387 |
| 5,472,057 | A | 12/1995 | Winfree | 175/57 |
| 5,495,892 | A | 3/1996 | Carisella | 166/387 |
| 5,560,426 | A | 10/1996 | Trahan et al. | 166/120 |
| 5,685,369 | A | 11/1997 | Ellis et al. | 166/195 |
| 5,901,787 | A | 5/1999 | Boyle | 166/135 |
| 5,901,789 | A | 5/1999 | Donnelly et al. | 166/381 |
| 6,021,850 | A | 2/2000 | Wood et al. | 166/380 |
| 6,098,717 | A | 8/2000 | Bailey et al. | 166/382 |
| 6,202,748 | B1 | 3/2001 | Carisella et al. | 166/187 |
| 6,325,148 | B1 | 12/2001 | Trahan et al. | 166/297 |
| 6,425,444 | B1 | 7/2002 | Metcalfe et al. | 166/387 |
| 6,478,091 | B1 * | 11/2002 | Gano | 166/373 |

* cited by examiner

METHOD OF EXPANDING A SAND SCREEN

BACKGROUND OF THE INVENTION

1. Field of the Invention

The present invention generally relates to well completion. More particularly, the present invention relates to methods for expanding an expandable sand screen. More particularly still, the present invention includes trip saving methods for use with an expandable sand screen.

2. Description of the Related Art

The completion of wells includes the formation of a borehole to access areas of the earth adjacent underground formations. Thereafter, the borehole may be lined with steel pipe to form a wellbore and to facilitate the isolation of a portion of the wellbore with packers. The casing is perforated adjacent the area of the formation to be accessed to permit production fluids to enter the wellbore for recovery at the surface of the well. Whether the well is drilled to produce hydrocarbons, water, or geothermal energy, or is intended as a conduit to stimulate other wells, the basic construction is substantially the same.

In order to eliminate or reduce the production of formation sand, a sand screen is typically placed adjacent to the perforations or adjacent to an open wellbore face through which fluids are produced. A packer is usually set above the sand screen and the annulus between the screen and the casing is then packed with a relatively course sand, commonly referred to as gravel, to form a gravel pack around the sand screen for filtering sand out of the in-flowing formation fluids. In open hole gravel pack installations, the gravel pack also supports the surrounding unconsolidated formation and helps to prevent the migration of sand with produced formation fluids.

Recently, technology has arisen making it possible to expand a tubular in a wellbore. These in-situ expansion apparatus and methods permit a tubular of a smaller diameter to be inserted into a wellbore and then expanded to a larger diameter once in place. The advantages of time and space are obvious.

The in-situ expansion technique has been applied to sand screens, or those tubular members at the lower end of production tubing designed to permit the passage of production fluid therethrough but to inhibit the passage of particulate matter, like sand. An exemplary sand screen that can be expanded in the wellbore is described in U.S. Pat. No. 5,901,789 which is incorporated by reference herein in its entirety. Generally, an expandable sand screen "ESS" consists of a perforated base pipe, woven filtering material and a protective, perforated outer shroud. Both the base pipe and the outer shroud are expandable and the woven filter is typically arranged over the base pipe in sheets that partially cover one another and slide across one another as the ESS is expanded.

In one method of in-situ expansion, a wedge-shaped cone member is inserted into the well adjacent an end of the expandable screen with the tapered surface of the cone decreasing in diameter in the direction of expansion. The cone typically is mounted on a separate string to permit it to move axially in the wellbore independent of the expandable screen. When the screen is adjacent the area where production fluid will enter the perforated casing, the cone is urged along the inner bore of the expandable screen, thereby expanding the screen's inner bore to the size of the outer diameter of the cone.

In another method of expansion, an expansion tool is run into the wellbore on a string of tubulars to a location within the expandable screen to be expanded. The expansion tool includes radially expandable roller members, which can be actuated against the wall of the screen via fluid pressure. In this manner, the wall of the screen can be expanded past its elastic limits.

One benefit from using the expandable sand screen is that, once expanded, the annular area between the screen and the wellbore or casing is mostly eliminated. Thus, the gravel pack may no longer be necessary. Further, in an open hole, the ESS may be expanded to a point where its outer wall places a stress on the wall of the wellbore, thereby providing support to the walls of the wellbore to prevent dislocation of particles.

On the other hand, problems exist with the present methods of expansion. For example, when a cone is used, the ESS has a tendency to "relax" after expansion. As a result, the ESS will form a loose fit with the casing or the wellbore. In many simple applications, the use of the more costly and complex roller based expansion method is not necessary. Further, both expansion methods rely on heavy and stiff expansion tubular strings which are not always readily available at job locations.

There is a need therefore for an apparatus and method to expand an expandable sand screen in order to form a tight fit between the screen and the wellbore or casing. There is yet a further need for an apparatus and method for expanding an expandable sand screen in a single trip.

SUMMARY OF THE INVENTION

The present invention provides apparatus and methods for expanding an expandable tubular in the wellbore. In one aspect, the expandable tubular is expanded using one or more packers. The one or more packers may include an inflatable packer or a mechanical packer. In another aspect still, the expandable tubular is an expandable sand screen.

In one embodiment, an apparatus including a section of expandable sand screen and an inflatable packer is disposed in the wellbore on coil tubing. Thereafter, the inflatable packer in actuated to expand the expandable sand screen adjacent to a producing area of the wellbore. In another embodiment, the expandable sand screen includes one or more sealing means disposed on the ends of the expandable sand screen to isolate the producing area. The expansion of the expandable sand screen will also expand the one ore more sealing means.

BRIEF DESCRIPTION OF THE DRAWINGS

So that the manner in which the above recited features and advantages of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
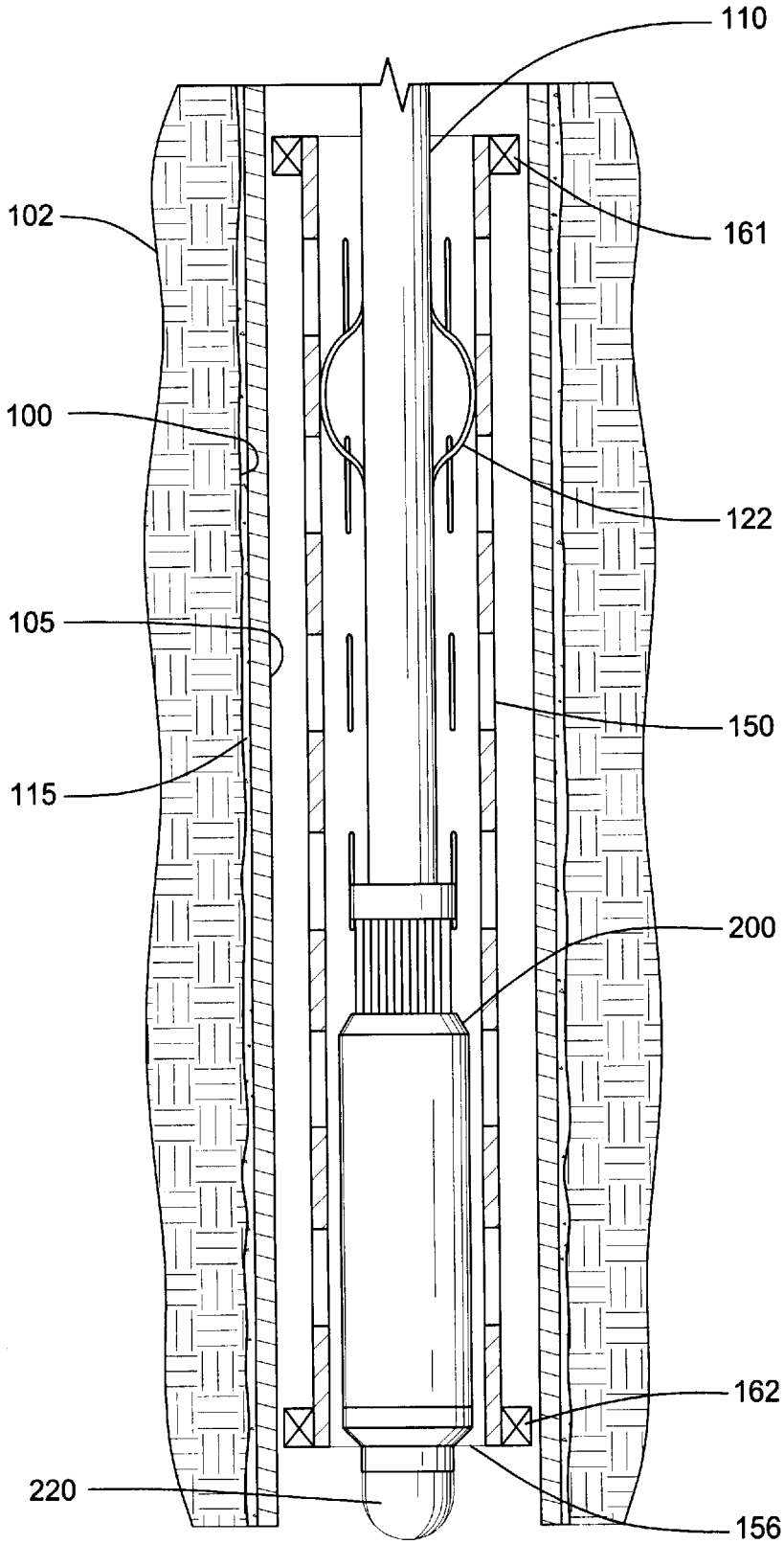
FIG. 1 is a section view showing a cased wellbore with an expandable sand screen and an inflatable packer disposed therein.

FIG. 1 is a section view of a wellbore 100 containing an expandable sand screen 150 releasably connected to an inflatable packer 200. The wellbore is lined with casing 105 and the annular area between the casing 105 and the earth 102 is filled with cement 115. While the wellbore 100 disclosed herein is a cased wellbore, the methods and apparatus of the present invention are useful with any wellbore, including horizontal wellbores and wellbores not lined with casing.

The inflatable packer 200 is attached to and lowered into the wellbore 100 using coiled tubing 110. In addition to coiled tubing 110, the inflatable packer 200 may also be lowered into the wellbore 100 using a wire or electric line, production pipe, casing, or other lowering means known to a person of ordinary skill in the art. A pump out plug 220 may optionally be temporarily connected to a lower end of the packer 200 using a shearable connection (not shown). Further, one or more centralizers 122 may be disposed between the coil tubing 110 and the expandable sand screen 150.

Figure 2:
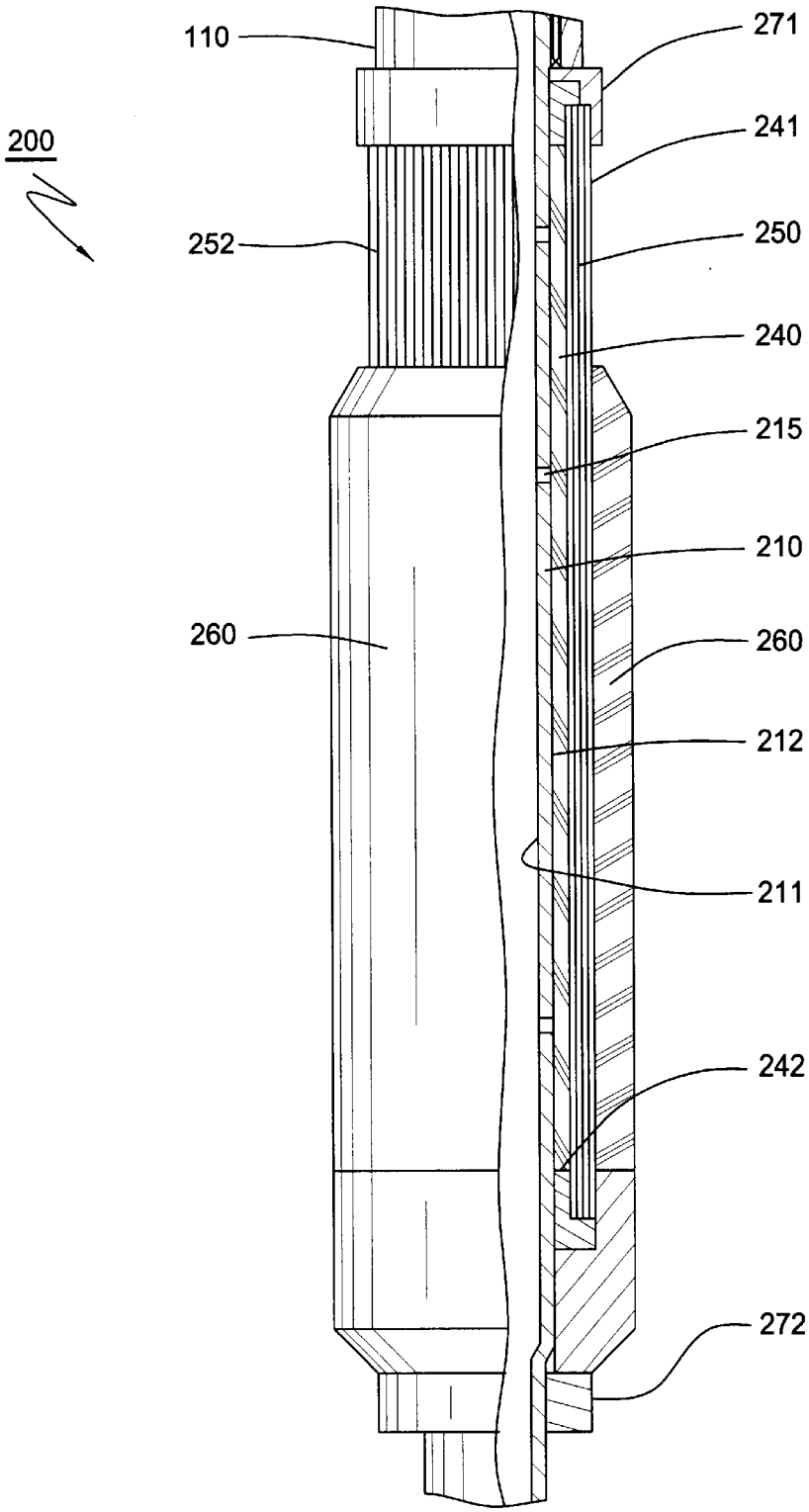
FIG. 2 is a schematic view of an inflatable packer.

FIG. 2 is a section view of an exemplary inflatable packer 200 suitable for use with the present invention. The inflatable packer 200 has a tubular body 210 which extends through the full length of the packer 200. Radial ports 215 are formed in the body 210 for fluid communication between an interior 211 of the body 210 and an exterior 212 of the body 210.

An inflatable elastomeric bladder 240 is concentrically disposed around the exterior 212 of the body 210. The bladder 240 is selectively movable between deflated and inflated positions by pressurized fluid introduced through fluid transmission means such as the radial ports 215 in the body 210. The bladder 240 may be surrounded and secured relative to a reinforcing sheath 250. The sheath 250 may be formed of a plurality of longitudinally extending strips or ribs 252 with each of the longitudinally extending strips 252 circumferentially overlapping an adjacent strip 252. The arrangement of the strips 252 in forming the sheath 250 is such that each of the strips 252 will at least partially overlap the next adjacent strip 252 at all times, i.e., both when the bladder 240 is deflated and inflated. Thus, the bladder 240 is reinforced by the sheath 250 throughout the expansion process. In another embodiment, the exterior of the sheath 250 may be partially or completely surrounded and bonded to an outer annular elastomeric packing cover 260.

An upper end 241 of the bladder 240 and the sheath 250 is sealably attached to the body 210 using a first collar 271 mounted to the body. Similarly, a lower end 242 of the bladder 240 and the sheath 250 are sealably attached to the body 210 using a second collar 272. The second collar 272 being slidably disposed on the body 210 for relative movement when the inflatable packer 200 is actuated. To actuate the packer 200, pressurized fluid is communicated from the interior 211 of the body 210 to the exterior 212 where it may be used to inflate the bladder 240. Upon inflation, the outer diameter of the bladder 240 is increased, thereby causing the bladder 240 and the sheath 250 to expand into contact with a surrounding tubular, such as an expandable sand screen. During the inflation, the second collar 272 moves axially toward the first collar 271 to accommodate the expansion of the bladder 240. The aspects of the present invention are equally applicable using other types of inflatable packers known in the industry, for example, the inflatable packers disclosed in U.S. Pat. Nos. 5,469,919 and 6,202,748, which patents are incorporated herein by reference in their entirety. Further, inflatable packers, as used herein, include inflatable packers and other fluid inflated bladders or devices. Furthermore, the inflatable packer 200 may be actuated by other means, such as electrical, mechanical, wire line, slick line, work string, and combinations thereof.

Figure 3:
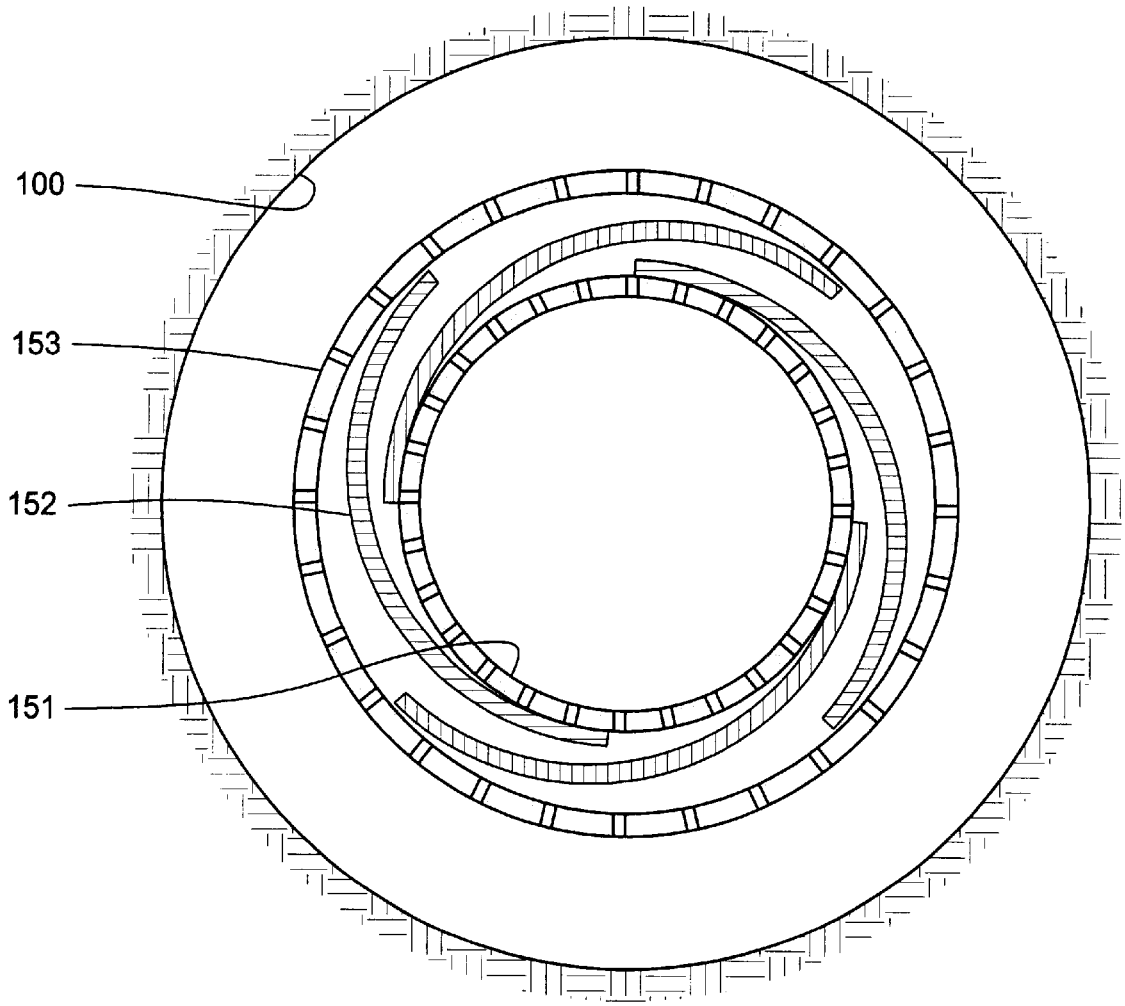
FIG. 3 is a cross-section view of the expandable sand screen in an unexpanded state.

As illustrated in FIG. 1, a lower end of the expandable sand screen ("ESS") 150 is releasably connected to the inflatable packer 200. An exemplary ESS 150 suitable for use with the present invention is described in U.S. Pat. No. 5,901,789, which is herein incorporated by reference in its entirety. In the embodiment shown, the ESS 150 is initially fixed to the inflatable packer 200 with a temporary connection 156 such as a shearable connection or some other temporary mechanical means. As illustrated in FIG. 3, which is a cross-sectional view of the ESS 150 disposed in a wellbore 100, the ESS 150 includes an expandable perforated inner tubular 151 and an expandable perforated outer shroud 153. At least one layer of filtering material 152 is disposed between the inner tubular 151 and the outer shroud 153. Preferably, the layer of filtering material 152 is arranged around the inner tubular 151 in sheets that partially cover one another and slide across one another as the ESS 150 is expanded. It must be noted that aspects of the present invention are suitable for use with other types expandable sand screens known to one of ordinary skill in the art as well as other types of expandable tubulars, including expandable solid tubulars and expandable slotted tubulars.

In the embodiment shown in FIG. 1, a sealing means 161, 162 is disposed on the exterior of each end of the ESS 150. An example of a suitable sealing means 161, 162 is a sealing element comprising an elastomeric material. The sealing elements 161, 162 provide a seal between the ESS 150 and the casing 105, thereby preventing unwanted fluid from the wellbore 100 from entering the ESS 150. Further, the sealing elements 161, 162 support and maintain the ESS 150 in the wellbore 100 during operation. The sealing means 161, 162 may also include a variety of packers capable of sealing and supporting the ESS 150 in the wellbore that are known to a person of ordinary skill in the art.

In operation, the inflatable packer 200 is lowered into the wellbore 100 using coiled tubing 110 as illustrated in FIG. 1. The ESS 150 is connected to the lower end of the inflatable packer 200 and lowered into the wellbore 100 with the inflatable packer 200. A centralizer 122 may be used to keep the packer 200 substantially centered in the ESS 150. The ESS 150 is lowered to a predetermined location where filtering of formation fluid is necessary.

When the ESS 150 has reached the predetermined location in the wellbore 100, the packer 200 is actuated. Pressurized fluid is introduced from the surface to actuate the packer 200. The pressurized fluid exits the body 210 of the packer 200 through the radial ports 215 and begins to inflate the bladder 240. Upon inflation, the bladder 240 expands radially to contact the inner wall of ESS 150 and applies an outward radial force thereto.

Figure 4:
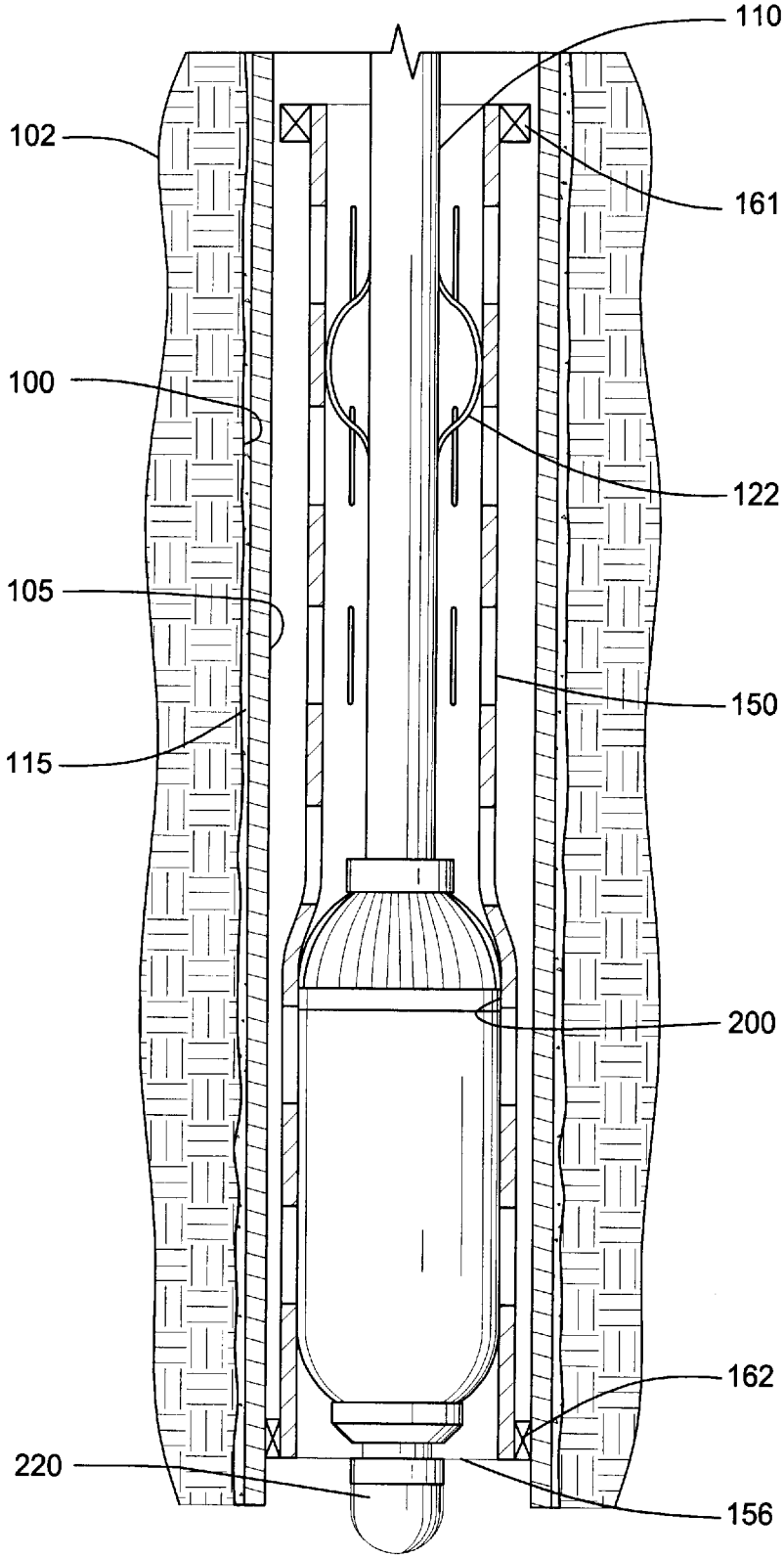
FIG. 4 is a section view of the wellbore with the screen partially expanded.

FIG. 4 is a section view illustrating the expandable sand screen 150 after it has been radially expanded against the casing 105 lining the wellbore 100. Radial force applied to the ESS 150 has forced the inner tubular and the outer shroud past their elastic limits. The expansion of the ESS 150 also expanded the lower sealing element 162 into contact with the casing 105, thereby "setting" the lower sealing element 162. The expanded lower sealing element 162 forms a seal between the ESS 150 and the casing 105 and supports the weight of the ESS 150.

Figure 5:
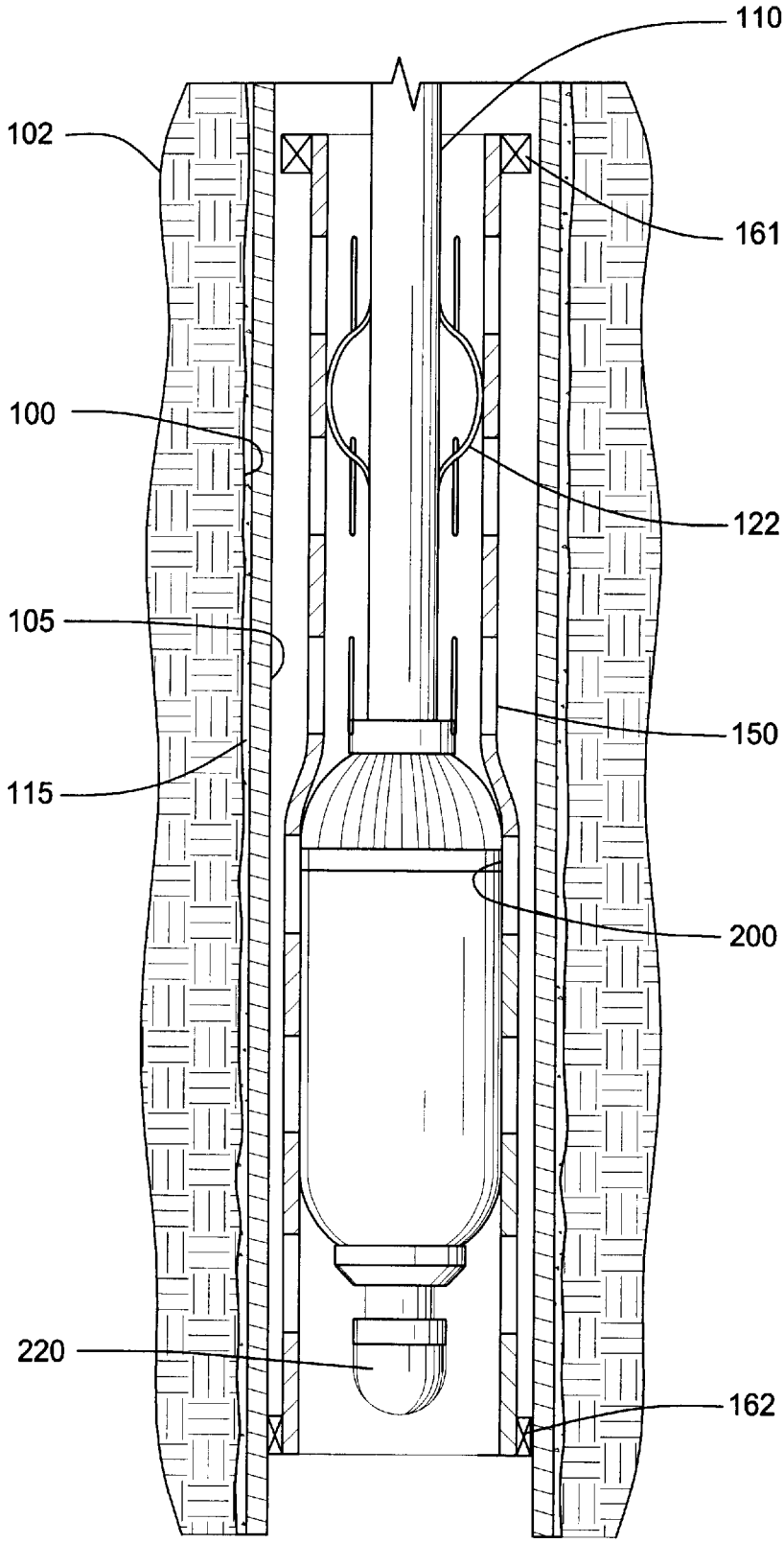
FIG. 5 is a section view of the wellbore with the screen partially expanded.

Because the ESS 150 is supported by the lower sealing element 162, the inflatable packer 200 may be deflated. Thereafter, the shearable connection 156 is disengaged to allow independent movement of the inflatable packer 200 relative to the ESS 150. The coiled tubing 100 may now move the inflatable packer 200 to another portion of the ESS 150 for expansion. FIG. 5 shows the inflatable packer 200 expanding another portion of the ESS 150. In this manner, the length of the ESS 150 can be circumferentially expanded into or nearly into contact with the casing 105 therearound.

Figure 6:
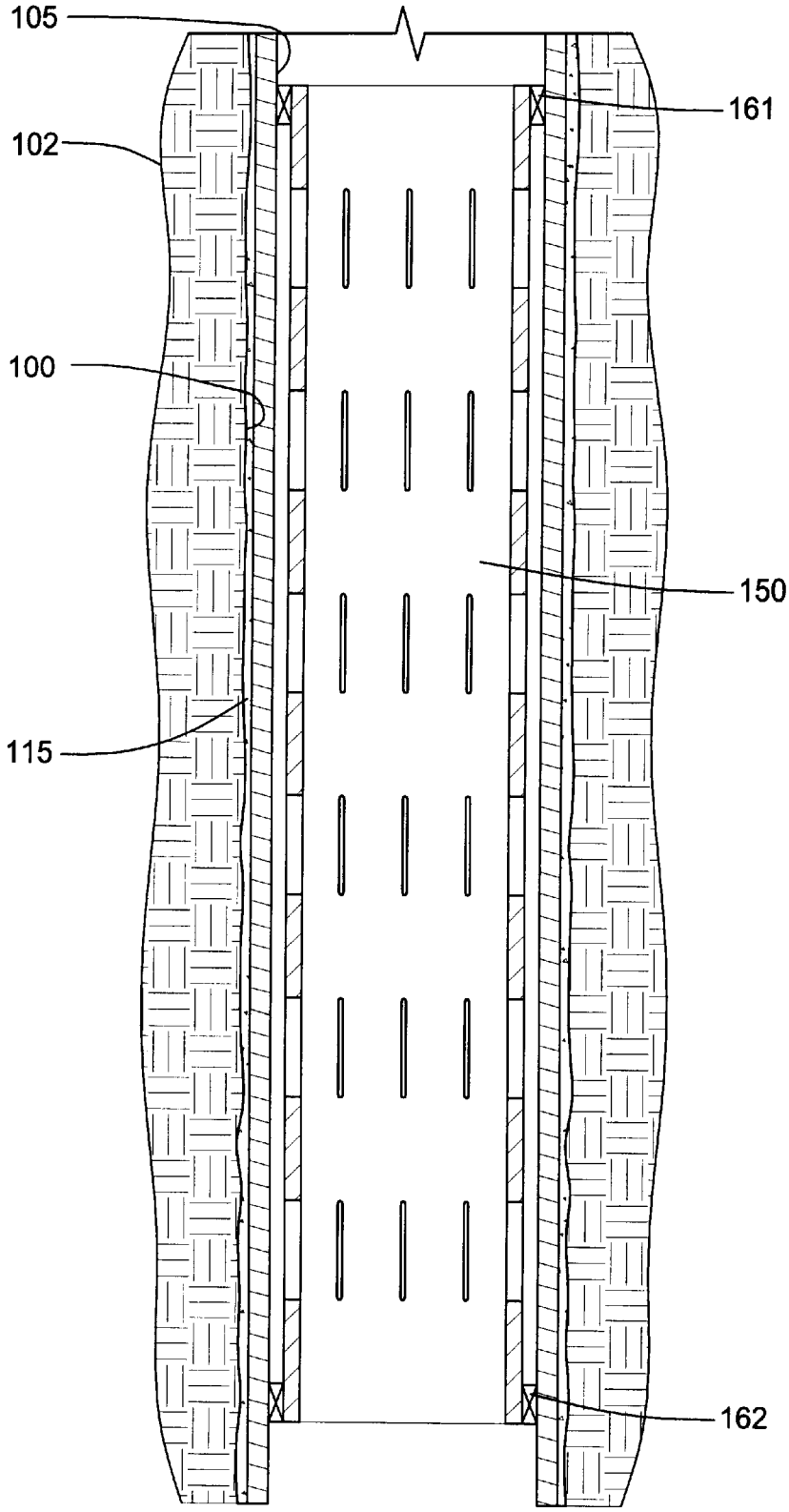
FIG. 6 is a section view of the wellbore with the screen fully expanded.

FIG. 6 is a section view illustrating the expandable sand screen 210 of the present invention after it has been expanded in a wellbore 100. Radial force applied to the inner wall of the ESS 150 has forced the inner tubular past its elastic limits and also expanded the diameter of the inner tubular. In addition, the lower and upper sealing elements 161, 162 have been set in the wellbore 100. Therefore, the placement of ESS 150 in the wellbore 100 was accomplished in one trip.

In another embodiment (not shown), one or more inflatable packers may be disposed on a working string and lowered into the wellbore with the ESS. As a result, multiple sections of the ESS may be expanded at the same time, thereby reducing the duration of the expansion process.

In another aspect, the inflatable packer may be lowered into the wellbore to expand an existing expandable tubular. In another aspect still, long lengths of ESS may initially be hung off of the surface of the wellbore. Thereafter, the inflatable packer may be lowered into the wellbore and connected to the ESS. Then, both the ESS and inflatable packer may be moved to a location in the wellbore where the ESS is to be expanded.

Figure 8:
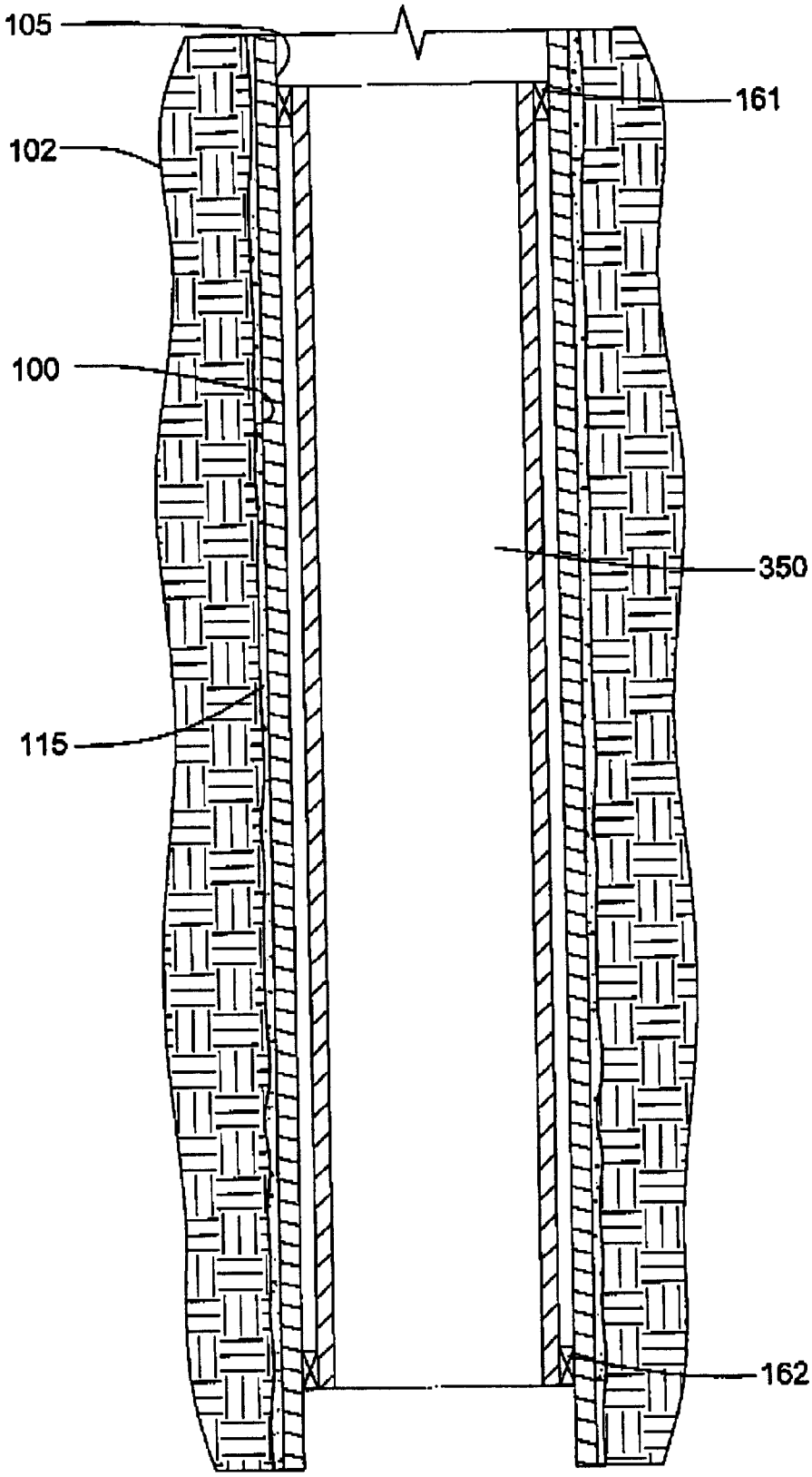
FIG. 8 is a section view of a solid tubular expanded in a wellbore.

FIG. 8 presents a section view of a solid tubular expanded in a wellbore.

Figure 7:
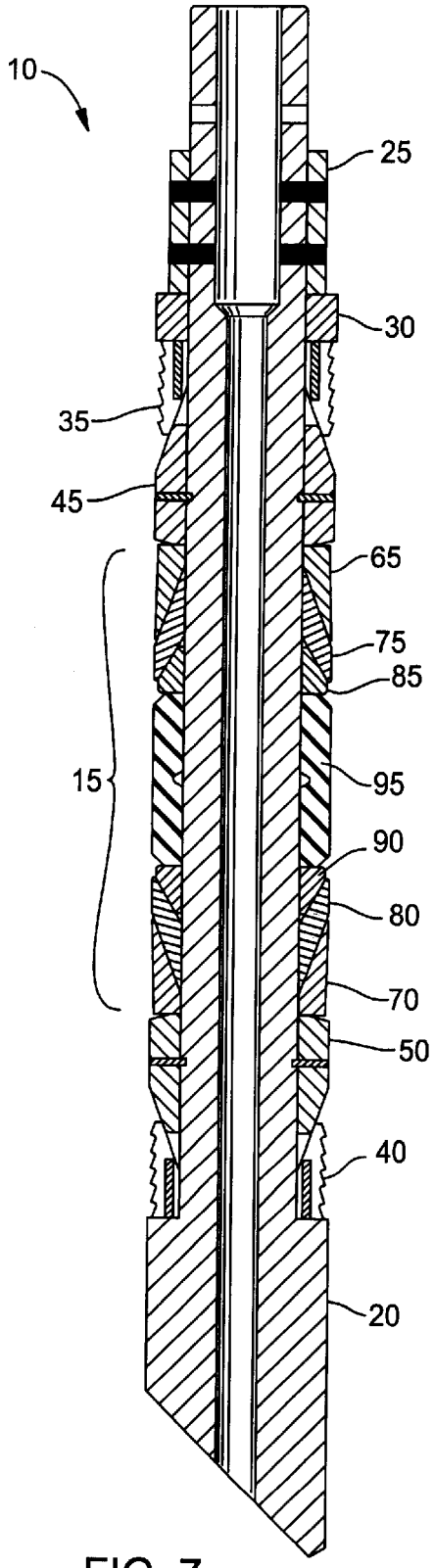
FIG. 7 is a section view of an exemplary mechanical packer.

In another aspect, the ESS may be expanded using a mechanical packer having a radially expandable sealing system. FIG. 7 illustrates an exemplary mechanical packer 10 suitable for use with the present invention. The mechanical packer 10 includes a sealing system 15 disposed around a mandrel 20. The sealing system 15 serves to expand ESS (not shown) against an inner wall of a casing (not shown) upon activation. The sealing system 15 includes a set support rings 65, 70 to contain a sealing element 95 upon activation of the mechanical packer 10. The support rings 65, 70 are disposed on the mandrel 20 and at least partially contact the tapered surface of expansion rings 75, 80. The expansion rings 75, 80 fill in gaps that are created during the expansion of the sealing element 95. The sealing system 15 further provides inner cones 85, 90 disposed about the mandrel 20 adjacent each end of the sealing member 95. A tapered edge on the inner cones 85, 90 urge the expansion rings 75, 80 radially outward upon activation of the mechanical packer 10.

The mechanical packer 10 may optionally include a pair of cones 45, 50, a pair of slips 35, 40, a top ring 30, and a setting ring 25. Upon activation of the mechanical packer 10, the cones 45, 50 urge the slips 35, 40 radially outward into contact with the ESS.

The mechanical packer 10 may be actuated using a separate setting tool (not shown). The setting tool is run into the wellbore with the mechanical packer 10. The setting tool operates to set the mechanical packer 10 by applying opposing forces to the inner mandrel 20 and the setting ring 30. In operation, an inner diameter of a setting tool straddles the top ring 25. The lower end of the setting tool abuts against setting ring 30. A force is applied to the setting tool from the surface to cause the lower end of the setting tool to push axially downward against the setting ring 30. At the same time, the inner diameter of the tool pulls up on the mandrel 20. The opposing forces urge the slips 35, 40 to ride up cones 45, 50 and contact the inner surface of the ESS. In turn, the expansion rings 75, 80 ride up the tapered surfaces of cones 85, 90 and compress the sealing member 95, thereby causing the sealing member 95 to expand outwardly into contact with the ESS. As more force is applied, the sealing member exerts pressure against the ESS to expand the ESS. In this manner, the ESS is expanded into contact with the surrounding casing. It must be noted that a mechanical packer, as used herein, also includes frac-plugs, bridge plugs, and other devices having a radially expandable sealing system as is known to a person of ordinary skill in the art.

While the foregoing is directed to embodiments of the present invention, other and further embodiments of the invention may be devised without departing from the basic scope thereof, and the scope thereof is determined by the claims that follow.

We claim:

1. A method of expanding a tubular in a wellbore, comprising:

lowering the tubular into the wellbore; and expanding a fist portion of the tubular with one or more packers;

moving the one or more packers; and expanding a second portion of the tubular.

2. The method of claim 1, wherein each of the one or more packers comprises an inflatable packer.

3. The method of claim 2, wherein the one or more inflatable packers are lowered into the wellbore together with the tubular.

4. The method of claim 1, wherein each of the one or more packers comprises a mechanical packer.

5. The method of claim 1, wherein expanding the tubular comprises increasing the inner and outer diameter of the tubular.

6. The method of claim 1, further comprising fixing the tubular in the wellbore.

7. The method of claim 1, wherein the tubular is a slotted tubular.

8. The method of claim 1, wherein the tubular is an expandable sand screen.

9. The method of claim 8, wherein the expandable sand screen comprises:

an inner tubular;

at least one layer of filtering material; and an outer tubular.

10. The method of claim 9, wherein the inner tubular comprises slots.

11. The method of claim 9, wherein the at least one layer of filtering material comprises at least two sheets of overlapping filtering material.

12. The method of claim 1, wherein the tubular comprises one or more sealing means.

13. The method of claim 12, wherein the one or more sealing means are disposed on an outer surface of the tubular.

14. The method of claim 13, wherein a first sealing means is disposed at a first end of the tubular and a second sealing means is disposed at a second end of the tubular.

15. The method of claim 12, wherein the one or more packers are lowered into the wellbore together with the tubular.

16. The method of claim 15, wherein the tubular comprises an expandable sand screen.

17. The method of claim 15, wherein the one or more packers comprise an inflatable packer.

18. The method of claim 17, wherein the one or more packers are connected to a lowering means selected from the group consisting of coil tubing, casing, production pipe, work string, wire line, and combinations thereof.

19. The method of claim 17, wherein the tubular is connected to the one or more inflatable packers using a shearable connection.

20. The method of claim 17, wherein the one or more inflatable packers are actuated by an actuating means selected from the group consisting of hydraulic means, electric means, work string, wire line, slick line, mechanical means, and combinations thereof.

21. The method of claim 17, wherein one or more centralizers are disposed between the tubular and the one or more inflatable packers.

22. The method of claim 15, wherein the one or more sealing means comprise an elastomeric material.

23. The method of claim 1, wherein the tubular comprises an expandable solid tubular.

24. An apparatus for completing a wellbore, comprising:

one or more packers;

a lowering means for lowering the one or more packers; and an expandable tubular releasably connected to the one or more packers.

25. The apparatus of claim 24, wherein the one or more packers comprises a mechanical packer.

26. The apparatus of claim 24, wherein the one or more packers comprise an inflatable packer.

27. The method of claim 26, further comprising a closure member disposed at a lower of the one or more packers.

28. The method of claim 26, wherein each of the inflatable packers comprises a reinforcement member.

29. The method of claim 28, wherein the reinforcement member comprises a longitudinally extending strip or a sheath.

30. The apparatus of claim 24, wherein the lowering means is selected from the group consisting of coil tubing, casing, production pipe, work string, wire line, and combinations thereof.

31. The apparatus of claim 24, wherein the expandable tubular comprises a slotted tubular.

32. The apparatus of claim 24, wherein the expandable tubular comprises a solid tubular.

33. The apparatus of claim 24, wherein the expandable tubular comprises an expandable sand screen.

34. The apparatus of claim 33, wherein the expandable sand screen comprises:

an inner tubular; and filtering material disposed around the inner tubular.

35. The apparatus of claim 34, wherein the expandable sand screen further comprises one or more sealing means.

36. The apparatus of claim 35, wherein the expandable sand screen further comprises an outer tubular.

37. The method of claim 24, further comprising a shearable member.

38. A method of expanding a tubular in a wellbore, comprising:

lowering the tubular into the wellbore; and connecting one or more packers to the tubular in the wellbore; and expanding a first portion of the tubular with one or more packers.

39. The method of claim 38, further comprising:

moving the one or more packers; and expanding a second portion of the tubular.

40. The method of claim 38, further comprising moving the one or more packers and the tubular to a predetermined location before expanding the first portion of the tubular.

41. The method of claim 38, wherein the tubular comprises an expandable screen.

42. The method of claim 38, wherein the one or more packers are releasably connected to the tubular.

43. The method of claim 38, further comprising releasing the one or more packers from the tubular.

44. A method of expanding a tubular, comprising:

expanding a first portion of the tubular using a packer;

moving the packer to a second portion of the tubular; and expanding the second portion.

45. The method of claim 44, wherein the tubular is selected from the group comprising a solid tubular, a slotted tubular, a sand screen, and combinations thereof.

46. The method of claim 44, further comprising fixing the tubular in a wellbore.

47. The method of claim 46, wherein fixing the tubular comprises expanding a sealing element against the wellbore.

48. The method of claim 44, further comprising lowering the packer and the tubular into the wellbore in one trip.

49. The method of claim 44, wherein packer comprises an inflatable packer or a mechanical packer.

* * * * *